US008191891B2

(12) United States Patent
Yamagata

(10) Patent No.: US 8,191,891 B2
(45) Date of Patent: Jun. 5, 2012

(54) PAPER FEEDING DEVICE HAVING TRAY WITH CURVED AUXILIARY MEMBER

(75) Inventor: Masanobu Yamagata, Kawasaki (JP)

(73) Assignee: Ricoh Company, Tokyo (JP)

( * ) Notice: Subject to any disclaimer, the term of this patent is extended or adjusted under 35 U.S.C. 154(b) by 49 days.

(21) Appl. No.: 12/457,970

(22) Filed: Jun. 26, 2009

(65) Prior Publication Data

US 2010/0001457 A1 Jan. 7, 2010

(30) Foreign Application Priority Data

Jul. 1, 2008 (JP) ..... 2008-172513

(51) Int. Cl.
*B65H 1/00* (2006.01)

(52) U.S. Cl. ..... 271/161; 271/148

(58) Field of Classification Search ..... 271/2, 126, 271/145, 121, 171, 148, 161, 160; 399/393
See application file for complete search history.

(56) References Cited

U.S. PATENT DOCUMENTS

| | | | | |
|---|---|---|---|---|
| 4,714,243 | A * | 12/1987 | Staniszewski | 271/171 |
| 5,549,290 | A * | 8/1996 | Long et al. | 271/166 |
| 5,918,874 | A * | 7/1999 | Armstrong et al. | 271/117 |
| 5,951,003 | A * | 9/1999 | Nojima et al. | 271/121 |
| 6,139,008 | A * | 10/2000 | Margiotta | 271/148 |
| 6,169,561 | B1 * | 1/2001 | Fisher, Sr. | 347/218 |
| 7,464,925 | B2 * | 12/2008 | Dobbertin et al. | 271/148 |
| 7,591,461 | B2 * | 9/2009 | Lien et al. | 271/126 |
| 7,665,726 | B2 * | 2/2010 | Kotera | 271/145 |
| 2009/0230608 | A1 * | 9/2009 | Kimura et al. | 271/10.01 |

FOREIGN PATENT DOCUMENTS

| | | | |
|---|---|---|---|
| JP | 03095029 | A * | 4/1991 |
| JP | 7-242347 | | 9/1995 |
| JP | 2560481 | | 10/1997 |
| JP | 10-35901 | | 2/1998 |
| JP | 2000-318860 | | 11/2000 |
| JP | 2002-284376 | | 10/2002 |
| JP | 2004-269070 | | 9/2004 |

OTHER PUBLICATIONS

Abstract for JP 3054572 published Mar. 8, 1991.

* cited by examiner

*Primary Examiner* — Jeremy R Severson
(74) *Attorney, Agent, or Firm* — Harness, Dickey & Pierce, PLC

(57) ABSTRACT

To provide a paper feeding device that can stably feed a recording media of an angle bottomed envelope or the like with a non-uniform thickness in which defects such as feeding failure, oblique feeding, dog ears and paper jamming or the like are not generated, a paper feeding device of the present invention includes a bottom plate 41 that sends up a recording media stacked thereon to a paper feeding position, a feeding device 24 that feeds an uppermost piece of the recording media sent up to the paper feeding position in which an auxiliary member 50 with a curved surface is disposed at least within a width directional area occupied by the paper feeding device 24 and atop an upper surface of the bottom plate 41, a height from each point of the curved surface of the auxiliary member 50 to the bottom plate 41 is non-uniform.

9 Claims, 7 Drawing Sheets

PAPER FEEDING DEVICE HAVING TRAY WITH CURVED AUXILIARY MEMBER

PRIORITY CLAIM

This application claims priority from Japanese Patent Application No. 2008-172513, filed with the Japanese Patent Office on Jul. 1, 2008, the contents of which are incorporated herein by reference in their entirety.

BACKGROUND OF THE INVENTION

1. Field of the Invention

The present invention relates to a paper feeding device with a constitution in which an envelope or the like with a non-uniform thickness across its whole surface, that is, a recording media having deviations in thickness is stably fed.

2. Description of the Related Art

An image forming apparatus of a copier, a printer, a facsimile, a hybrid machine thereof or an ink jet printer or the like includes a constitution in which a bulk of a recording media stacked on a paper feeding tray is fed piece by piece. Because the image forming apparatus is used for purposes of mechanistic diversity, the image forming apparatus is required to be adapted to various recording medias of differing size, thickness and material or the like. For example, an envelope is formed to have a bag shape. The envelope is obtained by bending over and sticking a piece or a plurality of pieces of sheet parts. Therefore, a thickness of an envelope is non-uniform. As a result, such envelopes in stacked form becomes difficult to be stably fed by a paper feeding device having a mechanism only suited for carrying a sheet shaped recording media of an uniform thickness. That is, when a paper feeding device designed for feeding a recording media of an uniform thickness is used to feed stacked envelopes, due to partial differences in thickness, there are cases in which feeding failure, oblique feeding, dog ears and paper jamming or the like are generated. Devices to solve such defects are respectively proposed by the following patent documents. In Japanese utility model registration No. 2560481, a constitution is disclosed in which a paper feeding axis is profiled to be parallel to a tilt of a sheet surface. In JP2002-284376A, a constitution is disclosed in which feeding is performed by a plurality of rollers and a transmission device of the drive forces of the rollers is disposed between the plurality of rollers. In JP2004-269070A, a constitution is disclosed in which an attachment is disposed on a bottom plate. The attachment is projected and has a plane shaped upper surface. However, recently, envelopes of a variety of sizes and structure are required to be handled by a paper feeding device of an image forming apparatus. Therefore, a variety of propositions have been made but no paper feeding device has been proposed heretofore in which stable feeding is successful with regard to an angle bottomed envelope with a large capacity and with cargo spaces formed by folding in both side surfaces and a bottom surface. That is, cargo spaces formed by valley folding are present in a bottom part and both side surfaces of an envelope so that a large capacity can be obtained without enlarging an external size of when the envelope is developed. In recent years, an envelope with such a merit is particularly preferable in businesses that handle envelopes with a large capacity, for example, in prescription works that handle pharmaceutical bags. In envelopes with cargo spaces, there is an envelope in which cargo spaces are formed in both side surfaces of the envelope. There is also a so called angle bottomed envelope in which cargo spaces are formed in both side surfaces and a bottom surface.

FIGS. 9A and 9B are a perspective view and a front elevational view that illustrates a structure of an angle bottomed envelope. The angle bottomed envelope 100 has a structure in which a bottom cargo space part 102 is folded back at a folding over part 101. With such a structure, when the angle bottomed envelope is in a state folded back, a thickness of the angle bottomed envelope becomes non-uniform. Therefore, when such envelopes are stacked in a bulk form as a recording media, differing parts has differing layer thicknesses. The number within FIG. 9B illustrates an example of the number of sheet pieces layered in each part of an envelope. In this example, twelve pieces of sheets are layered in a thickest part. Two pieces of sheets are layered in a thinnest part. As just described, the thickest part has a thickness six times to that of the thinnest part. When such an angle bottomed envelope is fed as a recording media through a paper feeding device of an image forming apparatus, conventional technologies illustrated in the above described patent documents cannot obtain a sufficient feeding quality. Next, FIGS. 10A and 10B illustrates a general paper feeding device equipped in an image forming apparatus. The paper feeding device is approximately constituted from a paper feeding tray 111 and a paper feeding roller (feeding device) 115. The paper feeding tray 111 includes a constitution in which a bottom plate 113 is supported to be freely movable upwardly and downwardly inside a casing 112. The bottom plate 113 is a device that sends up a recording media stacked thereon to a paper feeding position. The paper feeding roller is a device that feeds piece by piece towards an image forming part an uppermost piece of the recording media sent up to the paper feeding position. FIG. 10B illustrates a state in which a recording media P is stacked on the bottom plate 113. By a drive device disposed externally, the bottom plate rotates upwardly with one side thereof as a center of rotation to send up the recording media. FIG. 11A illustrates a state in which the angle bottomed envelopes as a recording media are stacked in a bulk. FIG. 11B is a front elevational view during descending of the bottom plate. FIG. 11C is a front elevational view during ascending of the bottom plate. As illustrated in FIG. 11A, when the angle bottomed envelopes are stacked, a state is present in which non-uniformity in thickness is accumulated. The bottom plate 113 rotates around a rotating center 113*a* and sends upwardly the angle bottomed envelope 100. When the angle bottom envelope is sent up to a certain height, the rotation stops. For a method that detects the height at this moment, a detection device can be disposed separately or a mechanism that detects a height of a recording media can be disposed in a carrying device. FIG. 11D further illustrates in detail from a front surface side the state at this moment. As illustrated in FIG. 11D, a density around a center of a width direction of the angle bottomed envelopes 100 is comparatively low to a peripheral part because a number of sheet pieces layered around the center is much less than that of the peripheral part. Therefore, when a central part of the angle bottomed envelope contacts the feeding roller 115, if the bottom plate 113 is further rotated upwardly, a state is present in which the feeding roller gradually sinks into the central part of the stack of the angle bottomed envelope 100. When the feeding roller 115 is rotated in this state by a second drive device disposed externally, a phenomenon of feeding failure is generated as a result because frictional forces between the feeding roller 115 and the angle bottomed envelope 100 become insufficient. In addition, oblique feedings occur due to non-uniform frictional forces generated. In addition, dog ears and paper jamming are also generated because a vicinity of both side surfaces of the angle bottomed envelope 100 in a vicinity of a tip edge of the angle bottomed envelope 100 in the feeding direction contact an external member.

SUMMARY OF THE INVENTION

An object of the present invention is to provide a paper feeding device and an image forming apparatus including the paper feeding device that can stably feed a recording media of an angle bottomed envelope or the like with a non-uniform thickness in which defects such as feeding failure, oblique feeding, dog ears and paper jamming or the like are not generated.

In order to achieve the above object, a paper feeding device of the present invention includes a bottom plate that sends up a recording media stacked thereon to a paper feeding position, a feeding device that feeds an uppermost piece of the recording media sent up to the paper feeding position in which an auxiliary member with a curved surface is disposed at least within a width directional area occupied by the paper feeding device and atop an upper surface of the bottom plate. A height from each point of the curved surface of the auxiliary member to the bottom plate is non-uniform. The auxiliary member is a flexible member capable of elastic deformation. Two opposed end edges of the flexible auxiliary member is stopped by an engaging part disposed on the bottom plate in which an intermediate part of the flexible auxiliary member is bulging upwardly. The bottom plate includes a pivotal support part that pivotally supports an end edge of the flexible auxiliary member so that the end edge can rotate in an upward and downward direction. The bottom plate also includes an engaging part that stops another end edge of the flexible auxiliary member. The another end edge of the flexible auxiliary member is stopped by the engaging part so that a constitution is realized in which the intermediate part of the flexible auxiliary member bulges upwardly.

DETAILED DESCRIPTION OF THE PREFERRED EMBODIMENTS

Figure 1:
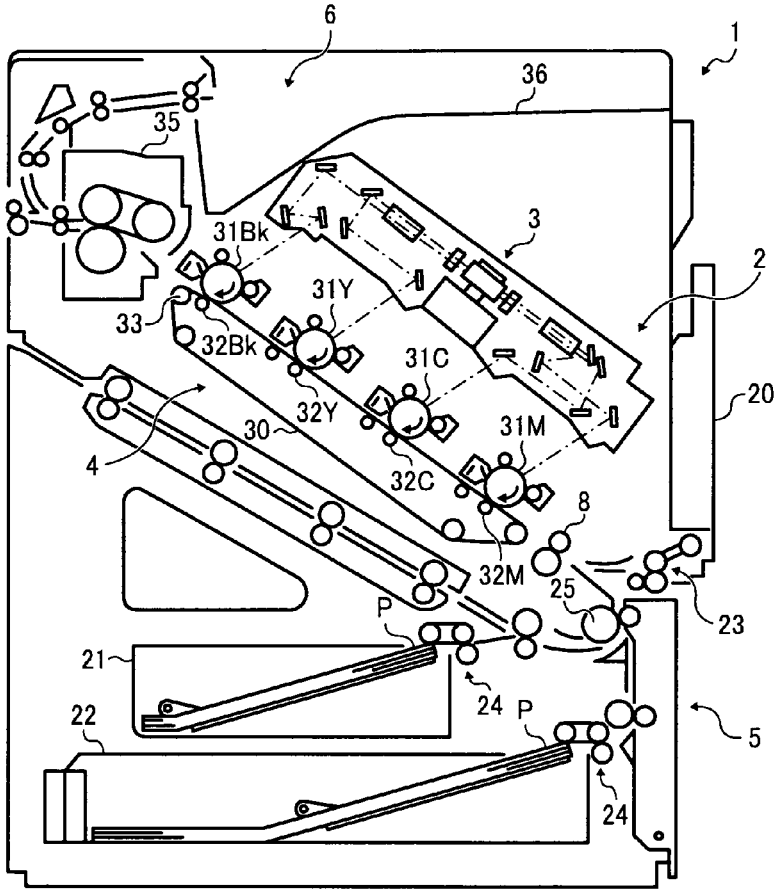
FIG. 1 is a diagram that illustrates an approximate constitution of an image forming apparatus according to the present embodiment or a color printer of a tandem type direct transfer method in this case.

The present invention is described in detail hereinbelow according to embodiments illustrated in the figures. FIG. 1 is a diagram that illustrates an approximate constitution of an image forming apparatus according to the present embodiment or a color printer of a tandem type direct transfer method in this case. The color printer 1 is approximately constituted from an image forming part 2 of an electro photography method, a writing optical system 3, an intermediate transfer part 4, a paper feeding part 5 and a paper discharge part 6. The paper feeding part 5 has three paper feeding trays that include one manual paper feeding tray 20 and two paper feeding cassettes 21, 22. A sheet shaped recording media (recording sheet) fed through the manual paper feeding tray 20 is separated piece by piece in sequence from an uppermost piece by a paper feeding device and carried to a resist roller pair 8 via a carrying roller pair 25. A recording sheet P fed from the paper feeding cassette 21 or 22 is separated piece by piece in sequence from an uppermost piece by a feeding roller (feeding device) 24 and carried to the resist roller pair 8 via the carrying roller pair 25. The paper feeding cassette 21, 22 and the feeding roller 24 constitutes the paper feeding device. The fed recording media P is stopped once by the resist roller pair 8. After skews are corrected, at a timing in which a predetermined position of a feeding direction of the recording media P matches a tip end of an image formed on a later described image support body, that is, a photoconductive drum 31M situated at a most upstream position, the recording media P is fed by a rotating movement of the resist roller pair 8 towards a transfer body, that is, transfer belt 30. The rotating movement of the resist roller pair 8 is controlled by an ON control of a not illustrated resist crutch.

A paper attachment nip is constituted from the transfer belt 30 and a not illustrated paper roller that comes into contact with the transfer belt 30 thereof. When the recording media P passes through the paper attachment nip, the recording media P is attached to the transfer belt 30 by an electrostatic force due to a bias impressed to the paper attachment roller and is carried at a predetermined process linear speed. A writing optical system 3 is a device that forms an electrostatic latent image on photoconductive drums 31M, 31C, 31Y and 31Bk used for each color. A transfer bias impressing member, that is, transfer rollers 32M, 32C, 32Y and 32Bk are disposed at positions corresponding to image support bodies of each color, that is, photoconductive drums 31M, 31C, 31Y and 31Bk with the transfer belt 30 put between thereof. When a transfer bias of a reverse polarity to a charging polarity of a toner is impressed to the transfer rollers 32M, 32C, 32Y and 32Bk, toner images of each color formed with an image in each photoconductive drum 31M, 31C, 31Y and 31Bk are transferred in a sequence of magenta (M), cyan (C), yellow (Y) and black (Bk) onto the recording media P attached to the transfer belt 30. After transfer processes of each color, the recording media P is self stripped from the transfer belt 30 at a position of a drive roller 33 situated downstream and carried to a fixing device 35. The recording media P passes through a fixing nip in the fixing device 35 so that a toner image is fixed to the recording media P by heat and pressure. The fixed recording media P, in the case of a single side printing mode, is discharged to a discharge tray 36 formed on an upper surface of the apparatus main body.

Figure 2:
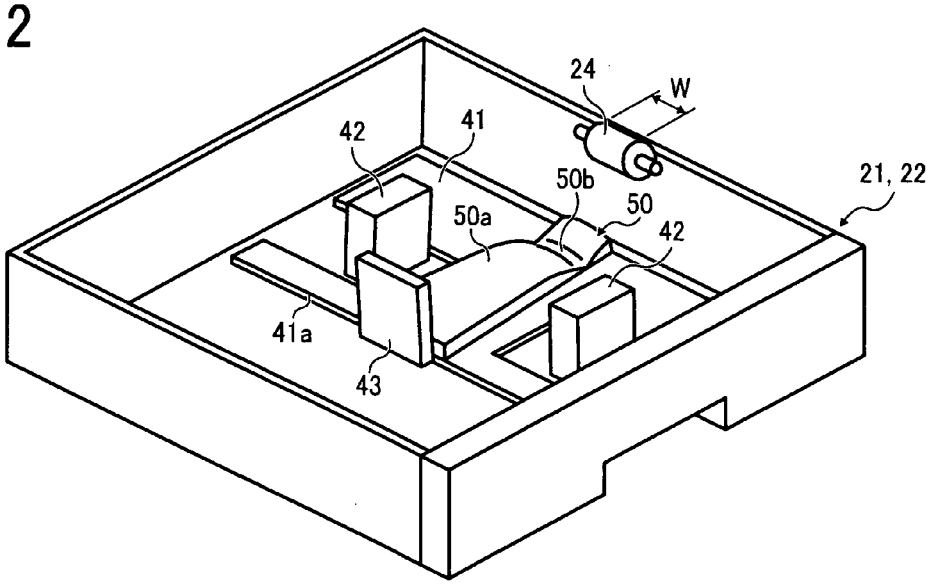
FIG. 2 is a perspective view of a paper feeding device according to an embodiment of the present invention.

Characteristic constitutions of the paper feeding device according to the present invention, as illustrated in FIG. 2, includes a bottom plate 41 that sends up a recording media P stacked thereof to a paper feeding position, a paper feeding roller (paper feeding device) 24 that feeds from an uppermost piece of the recording media sent up to the paper feeding position in which an auxiliary member 50 with a curved surface is disposed at least within a width directional area W occupied by the paper feeding roller 24 and atop an upper surface of the bottom plate 41. A height from each point of the curved surface of the auxiliary member to the bottom plate 41 is non-uniform. Paper feeding cassettes 21, 22 are open box shaped without a lid. On a bottom surface of the paper feeding cassettes 21, 22, a bottom plate 41 is supported to be capable of upward and downward movement with a side of one end edge 41a as an axial part. The paper feeding roller 24 is disposed in a leading side of a paper feeding direction of the bottom plate 41. A reference numeral 42 is a side fence. A reference numeral 43 is a back fence. A bottom surface of the auxiliary member 50 is fitted onto an upper surface of the bottom plate 41 to be in close contact thereof. An upper surface of the bottom plate is a curved surface in which a height from each point of the curved surface to the bottom plate 41 is non-uniform. A width directional dimension of the auxiliary member 50 (a direction orthogonal to a paper feeding direction) is at least the same as a width dimension W of the paper feeding roller 24 or preferably greater than W.

Figure 3A:
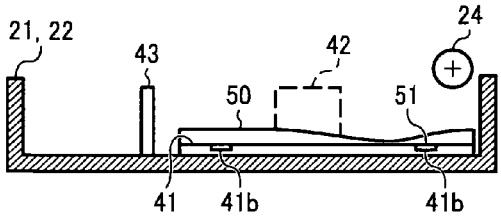
FIG. 3A is a longitudinal cross sectional front view that illustrates a constitution of the paper feeding device of FIG. 2.
Figure 3B:
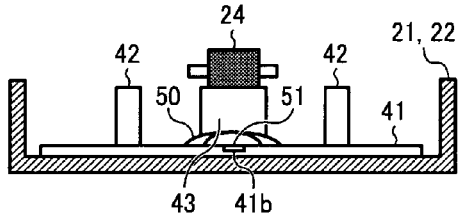
FIG. 3B is a longitudinal cross sectional side view that illustrates a constitution of the paper feeding device of FIG. 2.
Figure 9A:
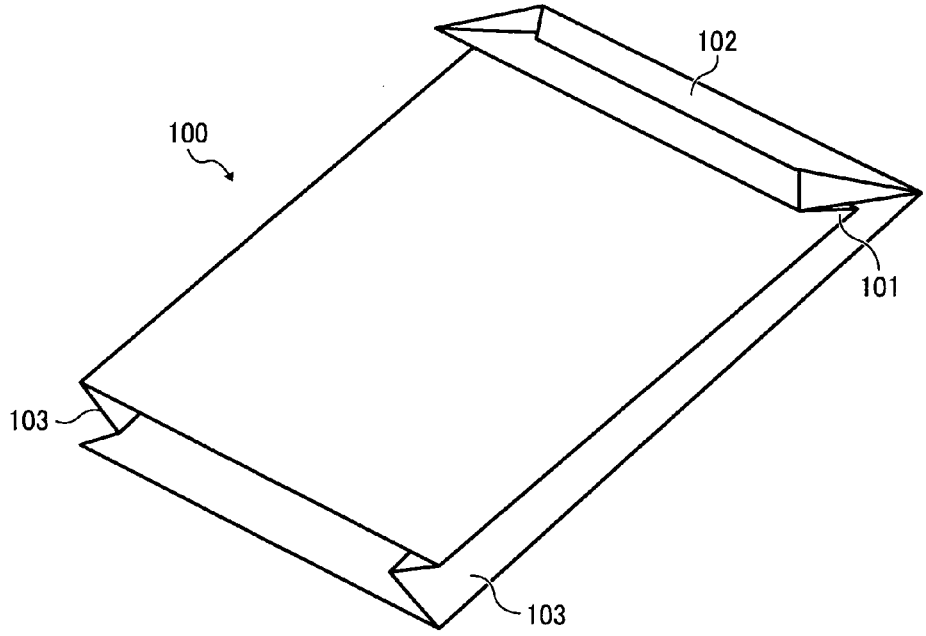
FIG. 9A is a constitutional schematic diagram of an angle bottomed envelope.
Figure 9B:
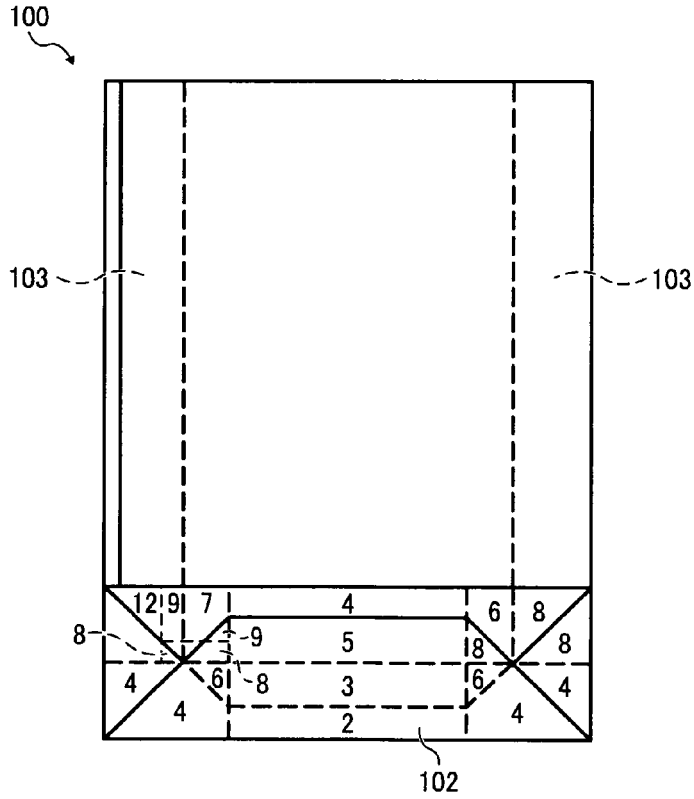
FIG. 9B is a front view of the angle bottomed envelope.

As illustrated respectively in the longitudinal cross sectional front view of FIG. 3A and the cross sectional side view of FIG. 3B, a projection 51 disposed on the bottom surface of the auxiliary member 50 is fitted into a hole (or, groove) opened on the bottom plate 41 so that a relative positional relationship between the bottom plate 41 and the auxiliary member 50 is determined. The upper surface of the auxiliary member 50 is constituted from a curved surface as illustrated in the figures. In such a way, when a plurality of pieces of the angle bottomed envelope 100 as illustrated in FIG. 9 is stacked onto the bottom plate 41, a thin walled part of the angle bottomed envelopes correspond to a convex surface (a high 50*a*) of the auxiliary member 50. A thick walled part of the angle bottomed envelopes correspond to a recess (a low 50*b*) of the auxiliary member 50. Therefore, when the bottom plate 41 is sent up to the paper feeding position, an uppermost surface of the angle bottomed envelope can become an approximate flat surface. In other words, a central part of a width direction of the angle bottomed envelope is in a state that matches a central part of a width direction of the auxiliary member 50, when the angle bottomed envelopes are stacked in a bulk on the bottom plate 41, an upper surface of the auxiliary member 50 is set to have a shape so that an upper surface of the central part of the width direction of the angle bottomed envelope (an area corresponding to a width of the paper feeding roller 24) is flattened towards the paper feeding direction. In the case a recording media of a differing thickness such as the angle bottomed envelope is not fed, the flexible auxiliary member 55 can be removed from the engaging part 41*c* and the apparatus can be used for paper feeding of a general recording media.

Figure 4A:
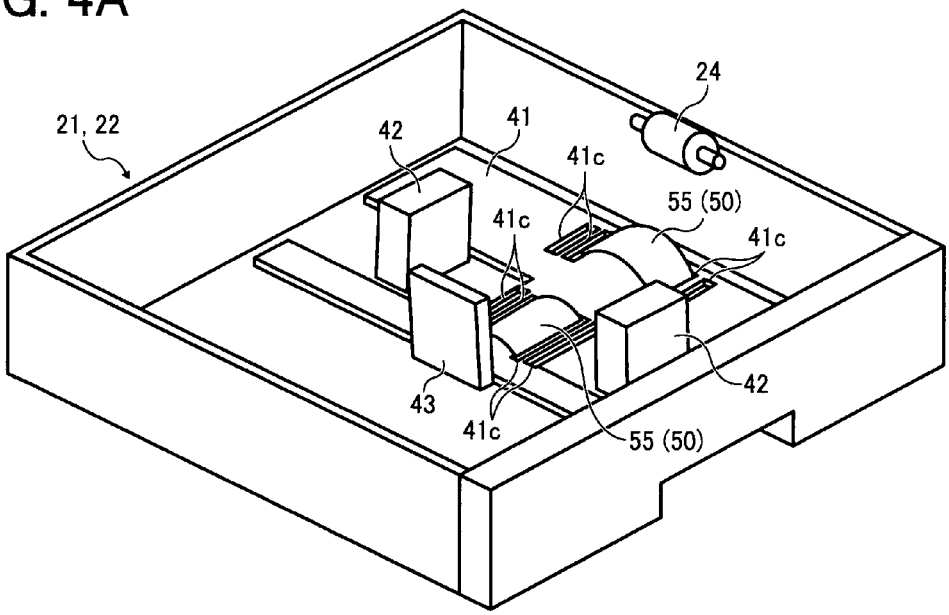
FIG. 4A is a perspective view that illustrates a constitution of a paper feeding device according to a second embodiment of the present invention.
Figure 4B:
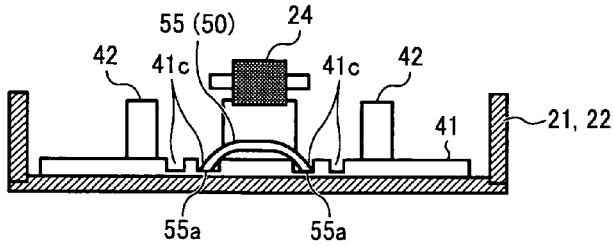
FIG. 4B is a longitudinal cross sectional side view that illustrates a constitution of the paper feeding device according to a second embodiment of the present invention.
Figure 5A:
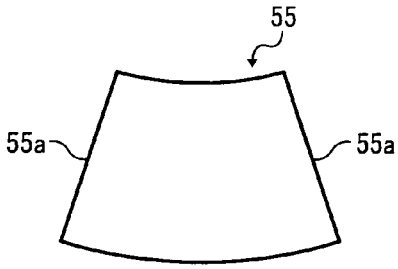
FIG. 5A is a schematic diagram of a constitutional example of a flexible auxiliary member.
Figure 5B:
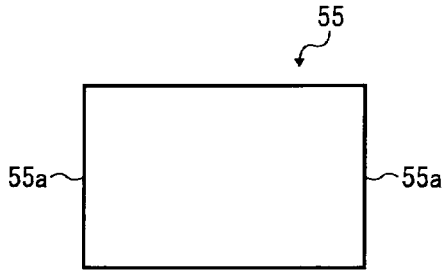
FIG. 5B is a schematic diagram of a constitutional example of the flexible auxiliary member.

Next, FIG. 4A is a perspective view that illustrates a constitution of a paper feeding device according to a second embodiment of the present invention. FIG. 4B is a longitudinal cross sectional side view that illustrates a constitution of the paper feeding device according to a second embodiment of the present invention. The auxiliary member 50 according to the present embodiment is a flexible auxiliary member 55 of a sheet material (thin plate) capable of elasticity deformation. Two opposed end edges 55*a* of the flexible auxiliary member 55 is stopped by an engaging part 41*c* disposed on the bottom plate 41 so that an intermediate part of the flexible auxiliary member bulges upwardly. A spread shape of the flexible auxiliary member 55 of the present example is for example fan-shaped as illustrated in FIG. 5A or a rectangular shaped sheet material as illustrated in FIG. 5B and is constituted from resins or materials having elasticity (flexibility) such as metals or the like. The engaging part 41*c* is a slit shaped groove or a through hole disposed on a proper place of the bottom plate 41. A plurality of pairs of each are disposed in the present example. Therefore, a constitution is adopted in which by selecting an engaging part 41*c* to be used, an upward bulging (curved) shape and a bulging height of the flexible auxiliary member 55 to be stopped can be adjusted arbitrarily. The engaging part 41*c* can be formed in a central part of a leading side of a paper feeding direction of the bottom plate 41 or a central part of a rear side of the paper feeding direction. Each engaging groove 41*c* is extended parallel to the paper feeding direction. The engaging part 41*c* can be formed on either of the positions. In correspondence to an uneven distribution in thickness of the angle bottomed envelopes set on the bottom plate, a height of projections of each movable auxiliary member 55 is adjusted. As a result, when the bottom plate 41 stacked with angle bottomed envelopes is sent up, it is possible to flatten an upper surface of a central part of the angle developed envelopes towards the paper feeding direction. In the case a recording media of a differing thickness such as the angle bottomed envelopes are not fed, the flexible auxiliary member 55 can be removed from the engaging part 41 and a normal recording media can be used for paper feeding.

Figure 6:
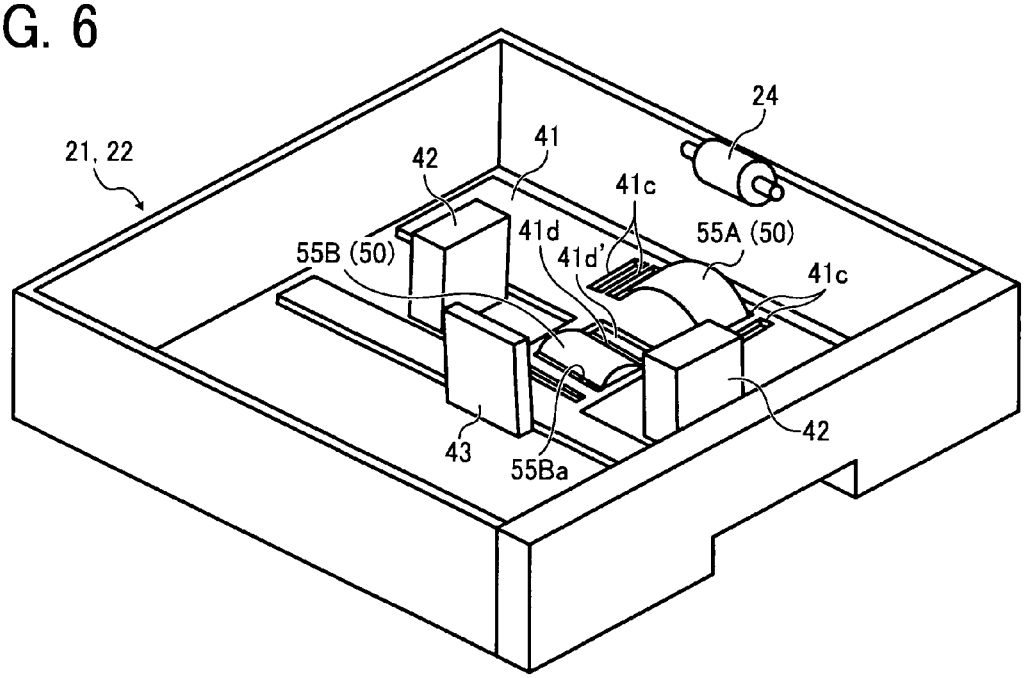
FIG. 6 is a perspective view that illustrates a constitution of a paper feeding device according to a third embodiment of the present invention.

Next, FIG. 6 is a perspective view that illustrates a constitution of a paper feeding device according to a third embodiment of the present invention. This paper feeding device includes another flexible auxiliary member (the second flexible auxiliary member) 55B and another engaging part (the second engaging part) 41*d* disposed in a rear side of the paper feeding direction in addition to a flexible auxiliary member (the first flexible auxiliary member) 55A disposed at a front side of the paper feeding direction and stopped by an engaging part (the first engaging part 41*c*) extending in the same direction as a fourth embodiment. One end edge 55Ba of the second flexible auxiliary member 55B is pivotally supported by the bottom plate to be freely rotatable in upward and downward directions. Another end is a free end. The second engaging part 41*d* is a device that stops the free end of the second flexible auxiliary member 55B. The second engaging part 41*d* is a slit shaped groove or a through hole that extends in a direction (width direction) orthogonal to the first engaging part 41*c*. Two or more of the second engaging part 41*d* are disposed to be parallel. The free end of the second flexible auxiliary member 55B can be stopped by any of the second engaging part 41*d* so that a central part of the second flexible auxiliary member 55B can bulge upwardly for only an arbitrary height. In addition, in the present example, the first flexible auxiliary member 55A and the second flexible auxiliary member 55B are extended in a mutually orthogonal direction but extension in the same direction is also possible. The second engaging part 41*d* is disposed within a recess 41*d*' having a thickness thicker than a wall thickness of the second flexible auxiliary member 55B. In the case the free end of the second flexible auxiliary member 55B is not stopped by the second engaging part 41*d*, the free end can be flatly extended and stored within the recess 41*d*'.

In the present example, the second flexible auxiliary member 55B is rotated with one end edge 55Ba as a center with the free end stopped by the engaging part 41. Consequently, in cooperation to the first flexible auxiliary member 55A, when a recording media with a non-uniform thickness such as the angle bottomed envelope is set for feeding, an upper surface of the recording media can be flattened and stable feeding becomes possible. With regard to a strength of the flexible auxiliary member 55, an upper limit detection sensor is almost always disposed on an upside of the paper feeding tray. Operations to send up the bottom plate 41 are stopped based on an output of the sensor. Therefore, a case in which the flexible auxiliary member does not function due to lack of strength can be sufficiently prevented by selecting a material with a certain degree of elastic force. In addition, in each of the above embodiments, a groove or a through hole is illustrated as the engaging part but if a engaging part can stop an end edge of the flexible auxiliary member, then a structure of the engaging part is not limited. For example, the engaging part can be a projection.

Figure 7:
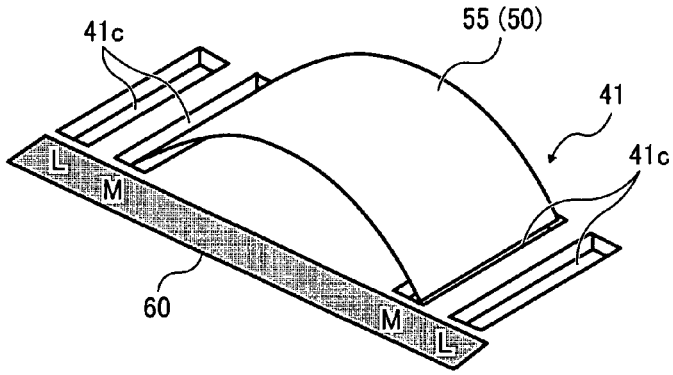
FIG. 7 is a constitutional schematic diagram of a modified example of a paper feeding device of the present invention.
Figure 8A:
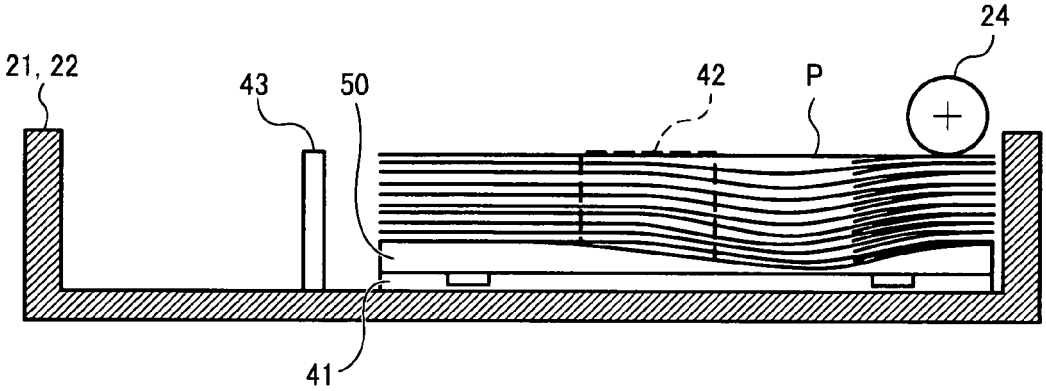
FIG. 8A is a schematic diagram of a state in which angle bottomed envelopes are stacked.
Figure 8B:
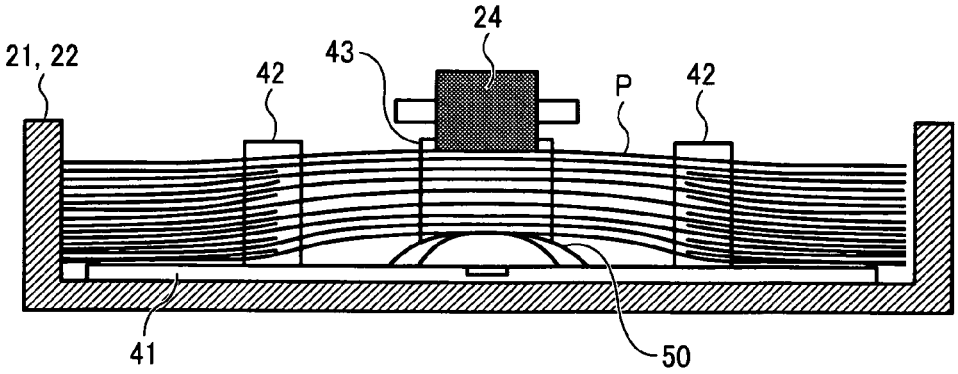
FIG. 8B is a schematic diagram of the state in which the angle bottomed envelopes are stacked.

Next, FIG. 7 is a modified example of a paper feeding device of the present invention. Hereby a marking 60 is disposed on a bottom plate surface corresponding to the engaging part 41*c* (the engaging part 41*d*). The marking 60 illustrates sizes or kinds of recording medias suited for a bulged shape formed by the flexible auxiliary member 55. The flexible auxiliary member is bulged because one free end thereof is stopped by an engaging part. Accordingly, by engraving a marking 60 that illustrates sizes, a user can understand in one glance where the auxiliary member needs to be disposed when the user needs to use recording medias of differing sizes. Consequently, a paper feeding device with good operability can be provided. As described above, according to the present invention, when a recording media with a non-uniform thickness such as angle bottomed envelopes are set for feeding, an uppermost surface of the recording media can be approximately flattened using the auxiliary member so that in the same way to a normal recording media with no deviations in thickness, defects such as feeding failure, oblique feeding, dog ears and paper jamming or the like are not generated and a stable feeding quality can be obtained. By using the flexible auxiliary member as the auxiliary member, when angle bottomed envelopes or the like are used as the recording media, an uppermost surface can be approximately flattened so that in the same way to a normal recording media with no deviations in thickness, defects such as feeding failure, oblique feeding, dog ears and paper jamming or the like are not generated and a stable feeding quality can be obtained. In addition, the shape of the flexible auxiliary member and its grappled position against the bottom plate can be changed in correspondence to a thickness of a paper used for making the angle bottomed envelopes so that a paper feeding device capable of obtaining a most appropriate feeding quality can be provided. In addition, the second flexible auxiliary member can be stored within the recess disposed on the bottom plate except when necessary so that a good operability can be provided.

Next, differences between the present invention and JP2004-269070A are as follows. First, JP2004-269070A is made based on a problem in which a paper thickness of a direction orthogonal to a feeding direction of a recording media is non-uniform. This is clear because JP2004-269070A only disclose an embodiment in which envelopes are disposed laterally. In addition, substantially, JP2004-269070A bottom raises only a direct under part of a paper feeding roller in which an attachment of a plane surface shape is disposed to uplift a part that comes into contact with the paper feeding roller. With this technology, a rear end of the paper remains at a low position but a tip end direction is uplifted in comparison so that defects such as feeding failures and skews or the like are generated. In contrast, in the present invention, the problem is to solve non-uniformity of thickness in both the paper feeding direction and the orthogonal direction to the paper feeding direction. A uniform height is achieved all the way through a rear end of the feeding direction of the recording media in the present invention. Using this method, correspondence is possible to mainly envelopes with a large capacity and having cargo spaces in the bottom part.

Figure 10A:
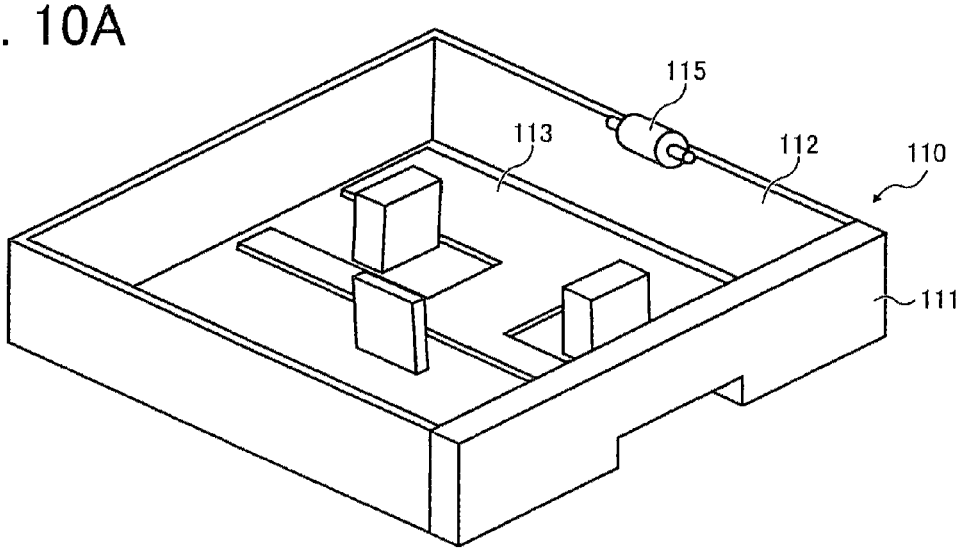
Conventional Art FIG. 10A
FIG. 10A is a perspective view that illustrates a constitution of a conventional paper feeding device.
Figure 10B:
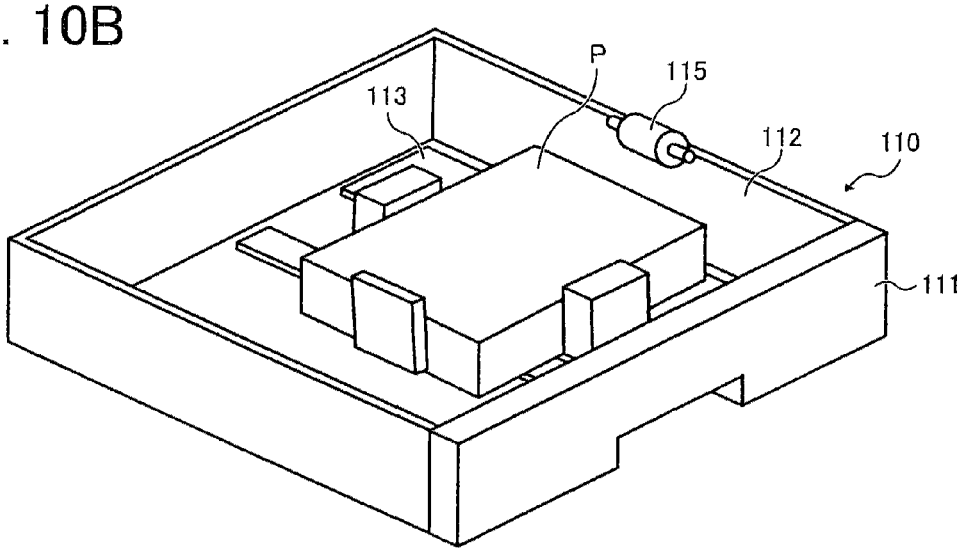
Conventional Art FIG. 10B
FIG. 10B is a schematic diagram that illustrates a state in which a recording media is set.
Figure 11A:
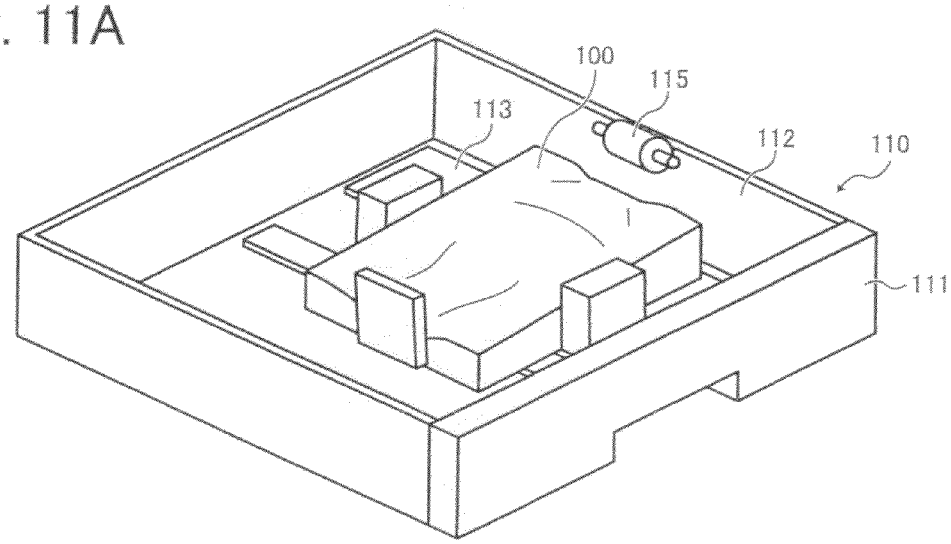
Conventional Art FIG. 11A
FIG. 11A is a conventional constitutional diagram that illustrates a state in which angle bottomed envelopes 100 are stacked in a bulk as a recording media.
Figure 11B:
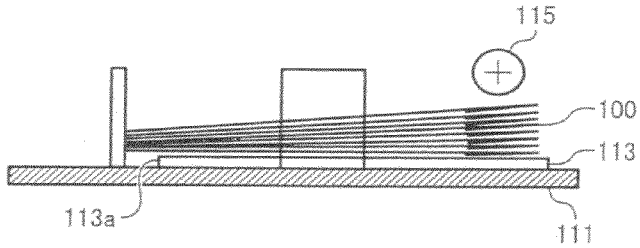
Conventional Art FIG. 11B
FIG. 11B is a front view during descending of a bottom plate.
Figure 11C:
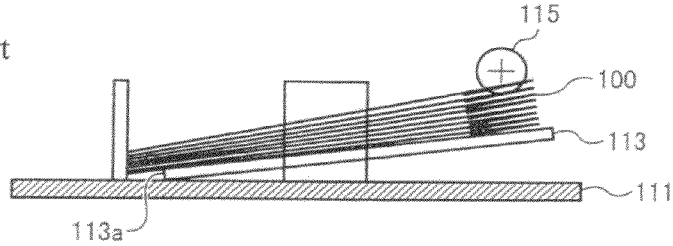
Conventional Art FIG. 11C
FIG. 11C is a front view during ascending of the bottom plate.
Figure 11D:
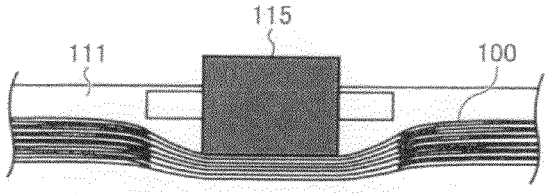
Conventional Art FIG. 11D
FIG. 11D is a side view of a state during paper feeding.

Next, JP H10-035901A relates to a technology that lifts a rear part of a paper by a rotating plane. JP H10-035901A differs from the present invention because a feeding target in the present invention is angle bottomed envelopes with cargo spaces in both side surfaces. JP H10-035901A does not consider thickness deviations of a lateral direction of an envelope. In JP H10-035901A, a rear part of an envelope is lifted up by a planar slope face so that both ends are lifted up more than necessary. The both ends are in friction with a structure or the like of an upper part of a paper feeding tray so that skews and unpleasant abnormal noises are generated and there are cases in which damages are generated to the paper. In contrast, as illustrated in schematic diagrams of FIGS. 10A and 10B of a stacked state, an upper surface of the stacked angle bottomed envelopes with lateral cargo spaces can be flattened in the present invention.

A paper feeding device of the present invention includes a bottom plate that sends up a recording media stacked thereon to a paper feeding position, a feeding device that feeds an uppermost piece of the recording media sent up to the paper feeding position in which an auxiliary member with a curved surface is disposed at least within a width directional area occupied by the paper feeding device and atop an upper surface of the bottom plate. A height from each point of the curved surface of the auxiliary member to the bottom plate is non-uniform. Therefore, a recording media of an angle bottomed envelope or the like with a non-uniform thickness can be fed stably in which defects such as feeding failure, oblique feeding, dog ears and paper jamming or the like are not generated.

What is claimed is:

1. A paper feeding device, comprising:

a bottom plate that moves up recording media stacked thereon to a paper feeding position;

a feeding device including a paper feeding roller that feeds an uppermost part of the recording media sent from the paper feeding position, and an auxiliary member disposed on the bottom plate and including an upper surface having a curved surface, wherein a width direction dimension of the auxiliary member is greater than or equal to a width dimension of the paper feeding roller, the auxiliary member is a flexible member capable of elastic deformation, and two opposing end edges of the flexible auxiliary member are stopped by engaging parts disposed on the bottom plate so that an intermediate part of the flexible auxiliary member bulges upwardly.

2. The paper feeding device according to claim 1, wherein the auxiliary member is a flexible member capable of elastic deformation, the bottom plate includes an engaging part that stops one end edge of the flexible auxiliary member and a pivotal support part that pivotally supports another end edge of the flexible auxiliary member so that the another end edge can rotate in upward and downward directions, the one end edge of the flexible auxiliary member is stopped by the engaging part so that an intermediate part of the flexible auxiliary member bulges upwardly.

3. The paper feeding device according to claim 2, wherein the engaging part is a groove, a through hole or a projection formed on the bottom plate.

4. The paper feeding device according to claim 2, wherein the flexible auxiliary member is stopped by the engaging part to form the bulged part, a marking is disposed on the engaging part to illustrate a size or a kind of a recording media suited for a shape of the bulged part.

5. An image forming apparatus including the paper feeding device of claim 1.

6. A paper feeding device, comprising:

a bottom plate that moves up recording media stacked thereon to a paper feeding position;

a feeding device including a paper feeding roller that feeds an uppermost part of the recording media sent from the paper feeding position, and an auxiliary member disposed on the bottom plate and including an upper surface having a curved surface, wherein a width direction dimension of the auxiliary member is greater than or equal to a width dimension of the paper feeding roller, the auxiliary member is a flexible member capable of elastic deformation, the bottom plate includes an engaging part that stops one end edge of the flexible auxiliary member and a pivotal support part that pivotally supports another end edge of the flexible auxiliary member so that the another end edge can rotate in upward and downward directions, the one end edge of the flexible auxiliary member is stopped by the engaging part so that an intermediate part of the flexible auxiliary member bulges upwardly.

7. The paper feeding device according to claim 6, wherein the engaging part is a groove, a through hole or a projection formed on the bottom plate.

8. The paper feeding device according to claim 6, wherein the flexible auxiliary member is stopped by the engaging part to form the bulged part, a marking is disposed on the engaging part to illustrate a size or a kind of a recording media suited for a shape of the bulged part.

9. An image forming apparatus including the paper feeding device of claim 6.

* * * * *